United States Patent [19]

Jennings et al.

[11] Patent Number: 4,595,063

[45] Date of Patent: Jun. 17, 1986

[54] SUBSEA CASING HANGER SUSPENSION SYSTEM

[75] Inventors: Charles E. Jennings; Bob C. Hopkins, both of Houston, Tex.

[73] Assignee: FMC Corporation, Chicago, Ill.

[21] Appl. No.: 535,470

[22] Filed: Sep. 26, 1983

[51] Int. Cl.[4] ..... E21B 43/01; F16L 35/00

[52] U.S. Cl. ..... 166/382; 166/217; 285/141

[58] Field of Search ..... 166/207, 208, 217, 382, 166/75 R, 83; 285/145, 146, 147, 148, 140, 142, 143

[56] References Cited

U.S. PATENT DOCUMENTS

| | | | |
|---|---|---|---|
| 3,090,438 | 5/1963 | Raulins | 166/75 |
| 3,105,552 | 11/1963 | Haeber et al. | 166/75 |
| 3,913,670 | 10/1975 | Ahlstone | 285/142 |
| 4,295,665 | 10/1981 | Pierce | 285/141 |
| 4,422,507 | 12/1983 | Reimert | 166/75 A |

*Primary Examiner*—Stephen J. Novosad
*Assistant Examiner*—William P. Neuder
*Attorney, Agent, or Firm*—Richard B. Megley; W. William Ritt, Jr.

[57] ABSTRACT

A subsea well casing suspension system whereby each of a plurality of concentric casing strings and its hanger is directly and totally supported on the wellhead housing, independently of all the other strings and their hangers, by a plurality of load ring slips that are components of a packoff assembly for an earlier installed casing string. When the packoff assembly is pressure tested following its installation, the load ring slips rise off the assembly and expand into their mating wellhead housing groove wherein they function to transmit the total hang load of the next casing string and hanger directly to that housing.

15 Claims, 15 Drawing Figures

146
44
132
140
134
128
144
142
136
138
126
20
50
128
90
130
60
86
84
152
54
62
64
80
34
58
56
66
154
26
22
74
72
70
74
76
78
150
74
72
68
74

FIG_4
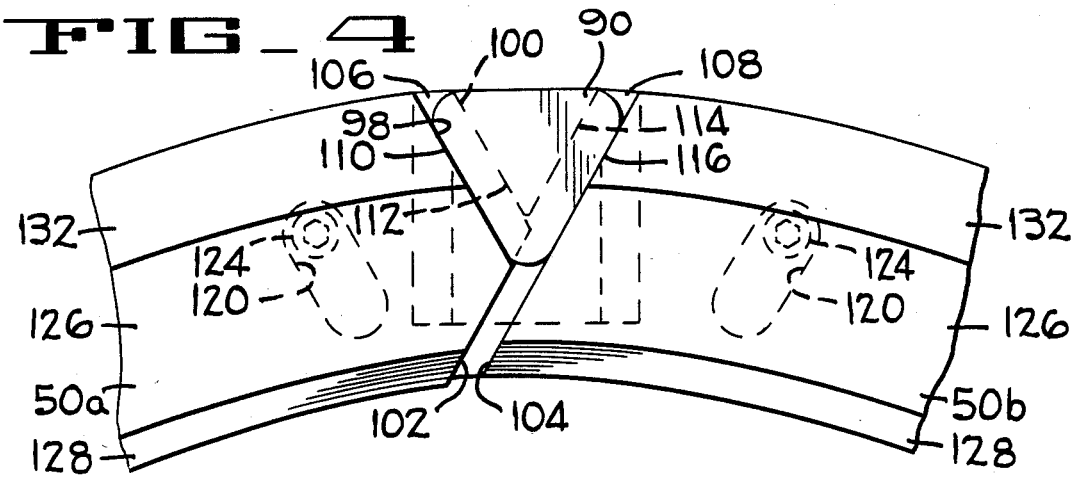
FIG_5
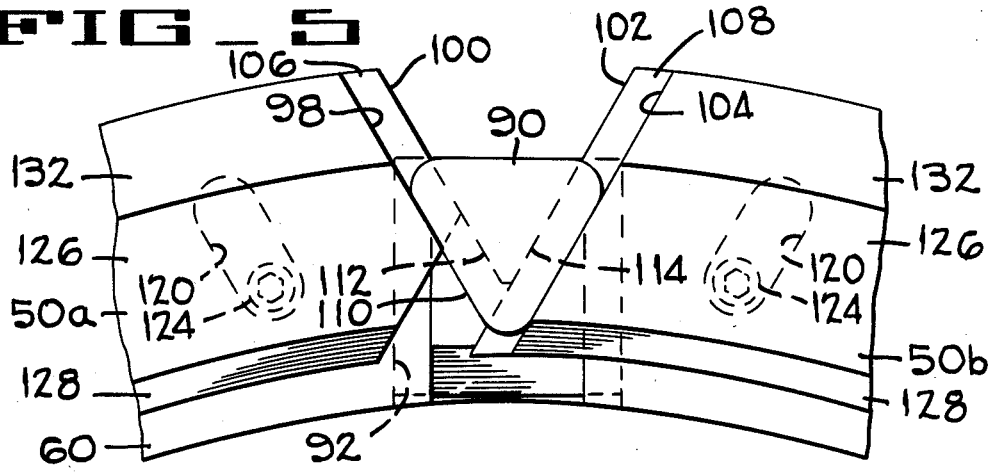
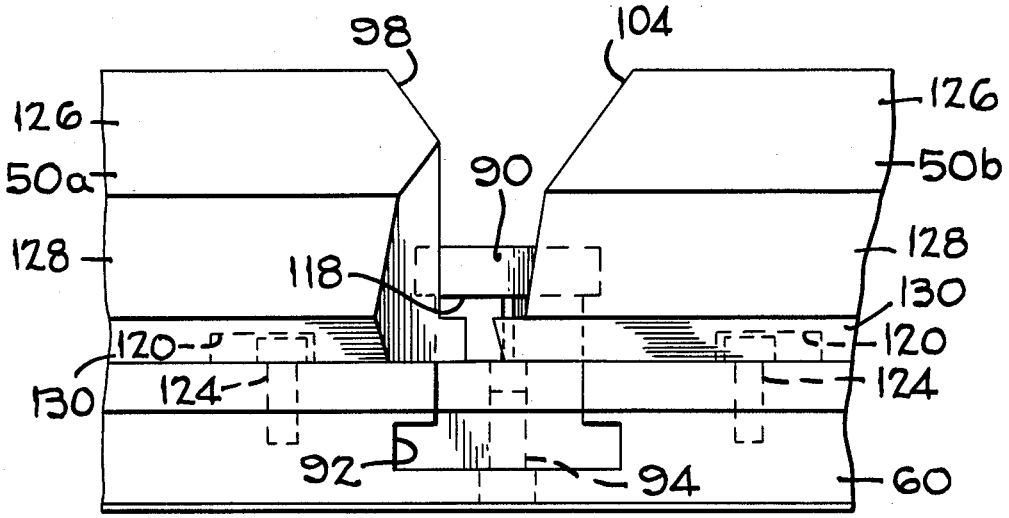
FIG_6

SUBSEA CASING HANGER SUSPENSION SYSTEM

This invention relates to well casing support systems, and more particularly to systems for suspending casing strings by hangers located in subsea wellheads.

BACKGROUND OF THE INVENTION

Most of the subsea well casing suspension systems currently employed in, or otherwise known to, the petroleum industry comprise a stacked downhole nesting of casing hangers, i.e., each progressively smaller hanger is stacked on, and thus supported by, the top of the previously installed hanger, whereby the total hang load of all the casing strings and their hangers plus the operating pressures in the well to which said strings and hangers are subjected is transferred to the wellhead at a single location near its base. There is a growing need in this industry for casing suspension systems capable of supporting hang loads and operating pressures considerably in excess of those for which the foregoing stacked systems were designed, and lately some higher performance designs have been proposed. However, each of these later designs results in placing all, or almost all, casing hang load and pressure load in a load path connection to a compressive load-carrying, hanger-bearing shoulder at the wellhead base. This stacked arrangement limits the hanger load carrying capability of the entire system, especially where it is exposed to a hydrogen sulfide environment which requires use of lower strength steels.

SUMMARY OF THE INVENTION

Broadly considered, the present invention involves an improved system for suspending well casing in a subsea wellhead, and more specifically a casing suspension system whereby each of a plurality of concentric casing strings and its hanger is directly and totally supported on the wellhead housing, independently of all the other strings and their hangers, by a plurality of expandable load ring slips that are run into the housing in retracted position with, and as a component of, the previous casing's packoff assembly. When the packoff assembly is pressure tested following its installation, the load ring slips expand radially into an annular groove in the inner surface of the housing, and as this expansion occurs the slips rise off the packoff assembly into proper position for supporting the next casing hanger. When this next hanger is lowered into the wellhead housing it precisely positions the load ring slips against the groove prior to imposing the hanger load on them, and in this final position the slips are spaced above, and thus out of contact with, the packoff assembly, resulting in a direct and compressive transfer of the total casing hang load onto the wellhead housing.

Since each casing string is supported by the wellhead housing independently of the other strings, the total load exerted by the casing strings, their hangers, and well test pressure that the suspension system of this invention can support is significantly greater than that supportable by other systems of comparable size. This increase is achieved even when lower strength materials are employed, such as is necessitated by the presence of hydrogen sulfide in the well. The improved load-carrying capability of this new system also facilitates deeper drilling programs to be accomplished offshore from floating drilling rigs.

Further benefits forthcoming from the casing suspension system of this invention include (1) all load ring slips are identical in manufacture and installation, (2) the packoff assemblies which also function as carriers for these slips are identical for all hangers, (3) prior to the installation of each casing hanger any cement or trash (contaminants) can be removed from the load ring slip groove by washout, and (4) the sealing areas for the packoff seal can be mechanically cleaned easily by means of a single running tool. For well completions, tie-back hanger sleeves can be stabbed into each casing hanger, tie-back hangers can be installed, locked and sealed by mechanical functions performed at the drilling deck, and other subsea completion equipment can be installed on the wellhead without requiring modification of design or procedures.

BRIEF DESCRIPTION OF THE DRAWINGS

FIG. 4 is a view of two adjacent load ring slips and their retainer taken along the line 4—4 of FIG. 3.

FIG. 5 is a view similar to FIG. 4, but showing the load ring slips in their expanded position.

FIG. 6 is a view taken along the line 6—6 of FIG. 3, but with the load ring slips in their expanded position as in FIG. 5.

DESCRIPTION OF THE PREFERRED EMBODIMENT

Figure 1:
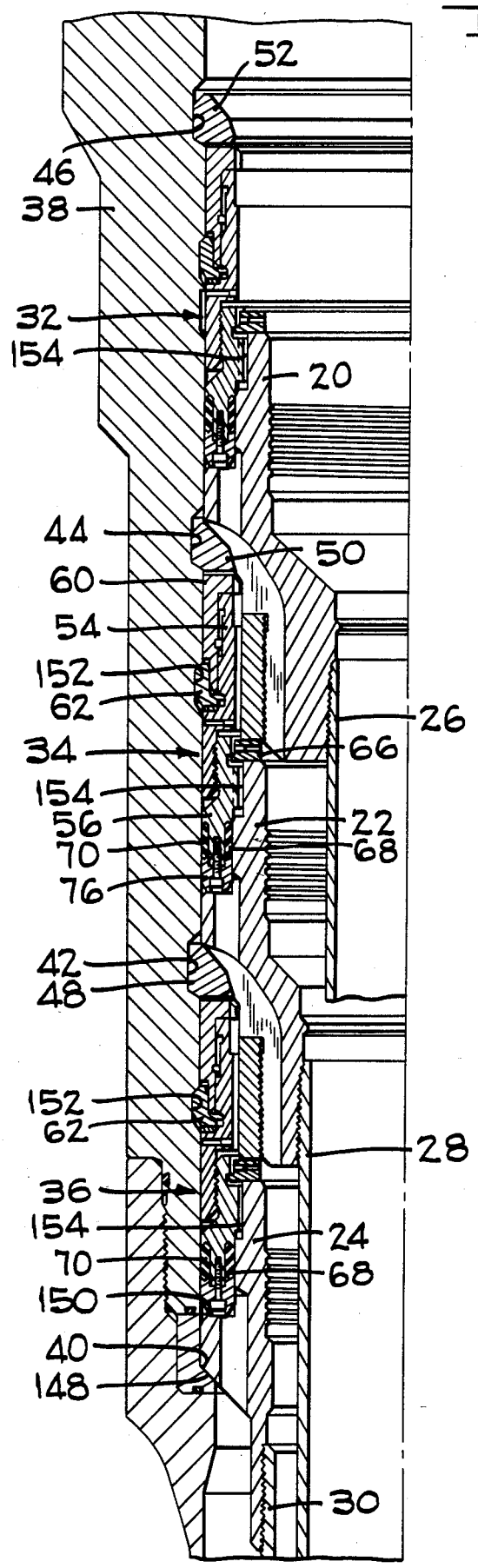
FIG. 1 is a fragmentary vertical central section through a subsea casing hanger suspension system according to the present invention, showing three concentric casing strings and their hangers installed in a wellhead housing.

As shown in FIG. 1, a subsea casing hanger suspension system according to the present invention comprises a casing hanger for each string of casing to be suspended, herein three hangers 20, 22, 24 for suspending three concentric casing strings 26, 28, 30, respectively, a packoff assembly with a plurality of load ring slips for each hanger, herein three assemblies 32, 34, 36 for the hangers 20, 22, 24 respectively, and a wellhead housing 38 in which the casing strings, their hangers and their packoff assemblies are installed. The wellhead housing 38 includes an annular shoulder 40 near its lower end to support the lowermost casing hanger 24, and spaced inner annular grooves 42, 44, 46 for receiving and supporting the load ring slips 48, 50, 52, respectively.

Figure 2:
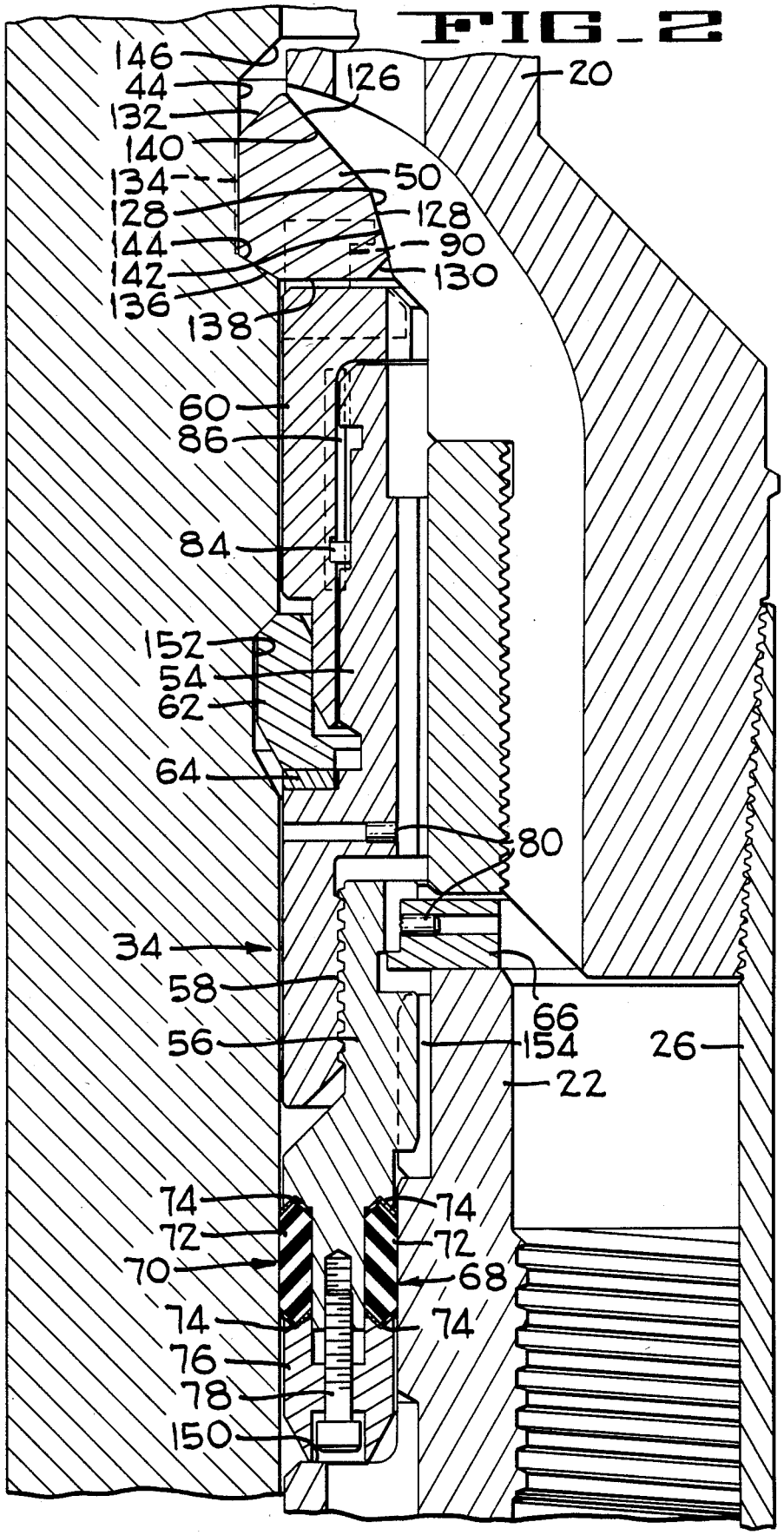
FIG. 2 is an enlarged fragmentary view of the uppermost casing hanger and adjacent elements of FIG. 1.
Figure 3:
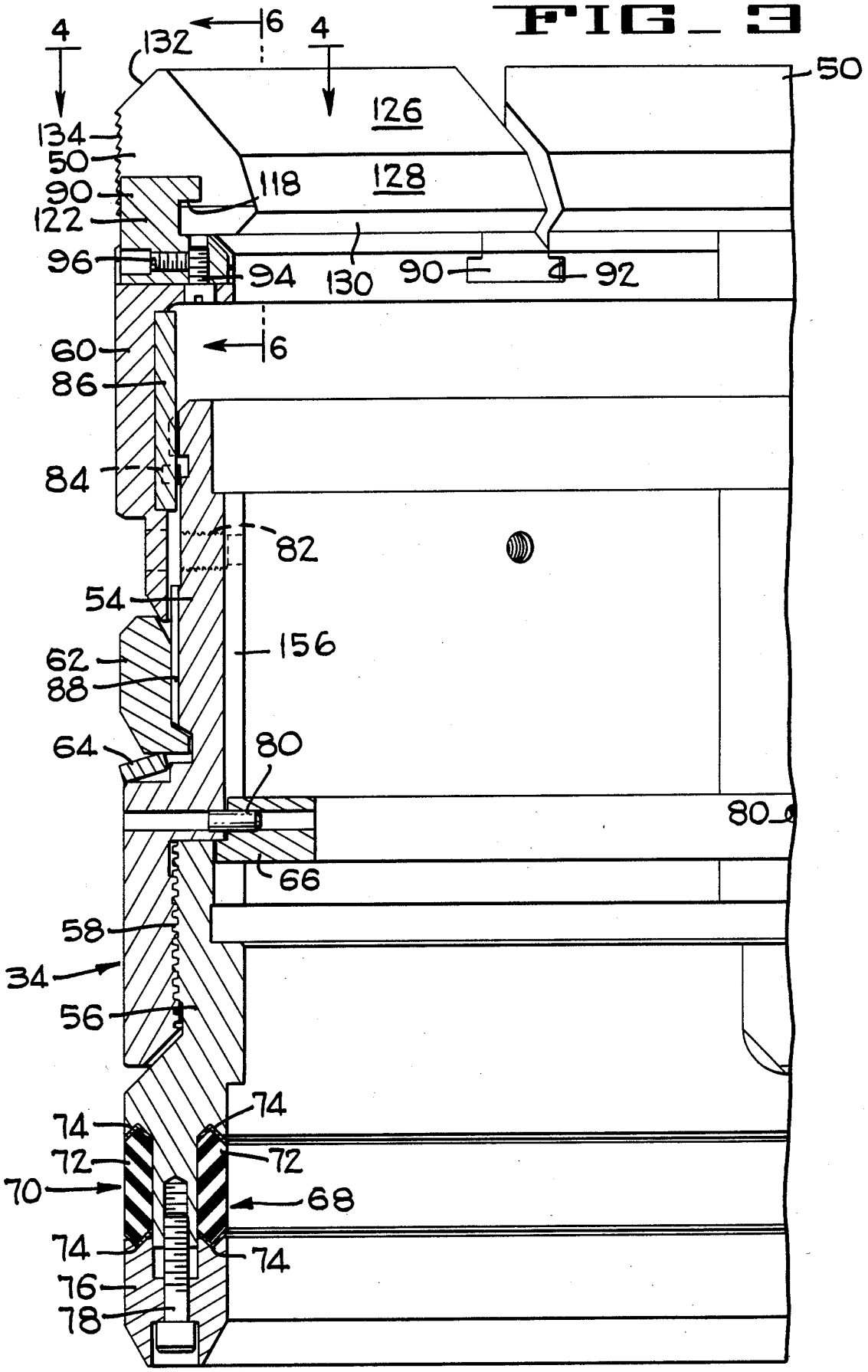
FIG. 3 is a fragmentary vertical central section through a packoff assembly according to the present invention.

The packoff assemblies 32, 34, 36 are identical, and thus a description of the assembly 34 (seen best in FIGS. 2 and 3) is equally applicable to the assemblies 32, 36. The assembly 34 comprises an upper body 54, a lower body 56 connected to the upper body 54 by threads 58, an expander mandrel 60 surrounding the upper portion of the upper body 54, an axially split lock ring 62 surrounding (FIG. 3) the upper body 54 below the expander mandrel 60, a frusto-conical energizing spring bushing 64 (FIG. 3) surrounding the upper body 54 below the lock ring 62, an anti-rotation ring 66 in and keyed to the upper end of the lower body 56, inner and outer annular packings 68,70 each comprising a compression set seal 72 and a pair of anti-extrusion metal rings 74, and a junk ring 76 secured to the lower end of the lower body 56, as by a plurality of circumferentially spaced cap screws 78 (only one shown), to retain the packings 68, 70 in position. As shown in FIG. 3 the anti-rotation ring 66 is releasably secured to the upper body 54 by a plurality of circumfrentially spaced shear pins 80 (two shown), and the entire packoff assembly 34 is releasably secured to a packoff running tool (not shown) by a shear pin 82 (portion only shown). A snap ring 84 between the expander mandrel 60 and the upper body 54 functions to axially retain the mandrel on the upper body, and a longitudinal key 86 secured to the bore of the mandrel cooperates with a keyway 88 on the opposed surface of the upper body to prevent relative rotation of the mandrel and the upper body while facilitating relative axial movement therebetween.

At the upper end of the expander mandrel 60 is a plurality (preferably six) of arcuate load ring slips 50 arranged end-to-end to form an annular load bearing shoulder for supporting the casing hanger 20 directly and totally on the wellhead housing 38. As seen best in FIGS. 2 and 4–6, the slips 50 are secured to the mandrel 60 by a plurality of circumferentially spaced retainers 90 located between the opposed ends of adjacent slips. The retainers 90 have a somewhat I-shaped configuration in front elevation, and a generally triangular-shaped configuration when viewed in plan. The retainers 90 reside in inverted T-shaped radial slots 92 in the end face of the mandrel 60 and are secured therein by axially-extending retainer cap screws 94, which screws 94 are secured in place by set screws 96.

As seen best in FIGS. 4–6, the opposed ends of adjacent load ring slips, for example 50*a*, 50*b*, have angular axial surfaces 98, 100, 102 and 104 and radial surfaces 106 and 108, respectively, that cooperate with adjacent angular surfaces 110, 112, 114 and 116 and radial surface 118, respectively, of the adjacent slip retainer 90 to retain the slips on the expander mandrel 60, while facilitating free radial movement of the slips with respect to the mandrel between their retracted position (FIG. 4) and their expanded position (FIG. 5). The bottom side of each end portion of each of the slips 50*a*, 50*b* has an elongated slot 120 into which projects a pin or cap screw 124 that extends upwardly from the top surface of the expander mandrel 60. The slots 120 and the pins 124 cooperate with the retainer 90 and the corresponding slip surfaces 106, 108 to direct radial movement of the slips 50*a*, 50*b* between their retracted (FIG. 4) and expanded (FIG. 5) positions, and the limits of such radial movement are defined by the amount of travel permitted by the length of the slots with respect to the diameter of the pin or of the head of the cap screw.

Figure 11:
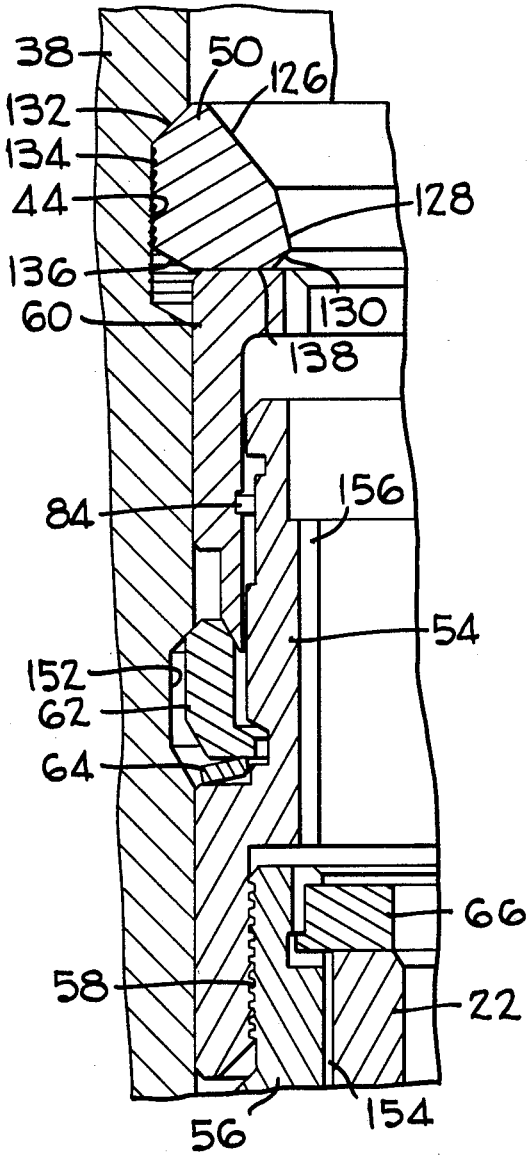
FIGS. 11 and 12 are views like FIGS. 7–10, showing the packoff assembly as it is being removed from the wellhead housing.
Figure 12:
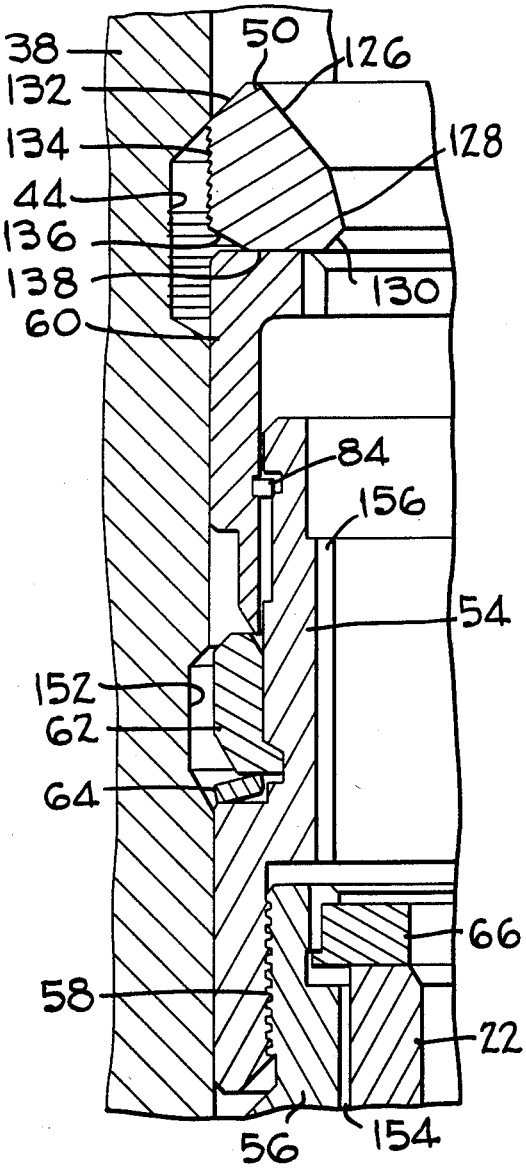

Each of the load ring slips 50 has a multisided configuration when viewed in cross section (FIGS. 1–3), including upper, intermediate and lower inner sloping surfaces 126, 128 and 130, respectively, an upper outer sloping surface 132, an intermediate outer axial toothed surface 134, a lower outer sloping surface 136, and a radial bottom surface 138. The upper and intermediate inner sloping surfaces 126, 128 cooperate with the packoff running tool (not shown) to effect a ramp wedging of the load ring slips outwardly from their retracted position (FIGS. 3 and 4) toward their fully expanded position (FIGS. 2 and 5), and also to provide a support seat for the casing hanger 20 which has correspondingly sloped annular surfaces 140, 142. The lower outer sloping surface 136 of the slips 50 cooperates with the opposed annular lower sloping surface 144 of the wellhead housing groove 44 to effect a rise of the slips off of the top of the packoff assembly, and specifically off of the expander mandrel 60, as the slips are expanded, and also to provide a strong annular seat for directly supporting the slips on, and transferring the compressive load imposed on the slips by the hanger 20 to, the wellhead housing 38. The outer axial toothed surface 134 of the slips 50 engage the axial surface of the groove 44 (FIG. 2) and thus assist in providing a secure support for the hanger 20 on the wellhead housing 38. The upper outer sloping surface 132 of the slips 50 cooperates with the annular upper sloping surface 146 of the wellhead housing groove 44 to cam the slips inwardly toward their retracted position as the packoff assembly 34 is lifted out of the wellhead (FIGS. 11 and 12).

OPERATION/FUNCTION

Installation of First Casing Hanger and Packoff Assembly

The subsea casing hanger suspension system of the present invention is designed for efficient drilling operations with minimum engagement/installation operations from the drilling deck. No thread engagement is required downhole until a tieback or completion operation is required.

The first (largest) casing string 30, including its hanger 24, is lowered into the well until the hanger shoulder 148 lands on the wellhead housing shoulder 40, and the casing 30 is then cemented in place. It should be noted that in this casing hanger suspension system the wellhead housing shoulder 40 is required to support only the casing string 30 and its hanger 24.

Figure 7:
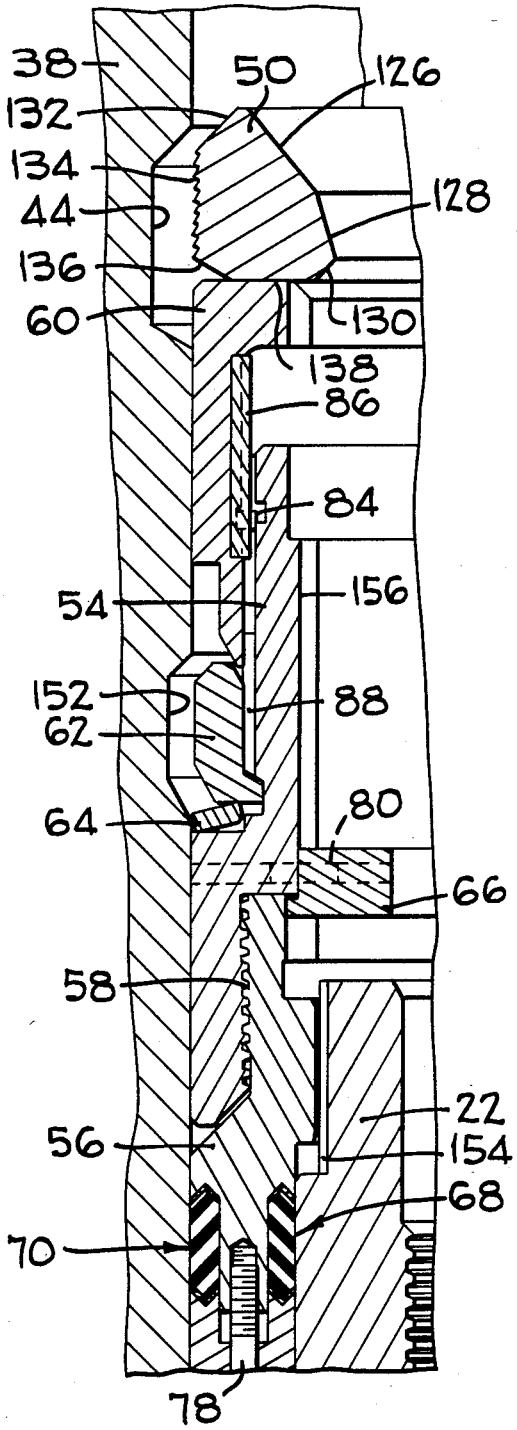
FIGS. 7–9 are fragmentary sequential operational views of a packoff assembly during its installation in a wellhead housing.
Figure 8:
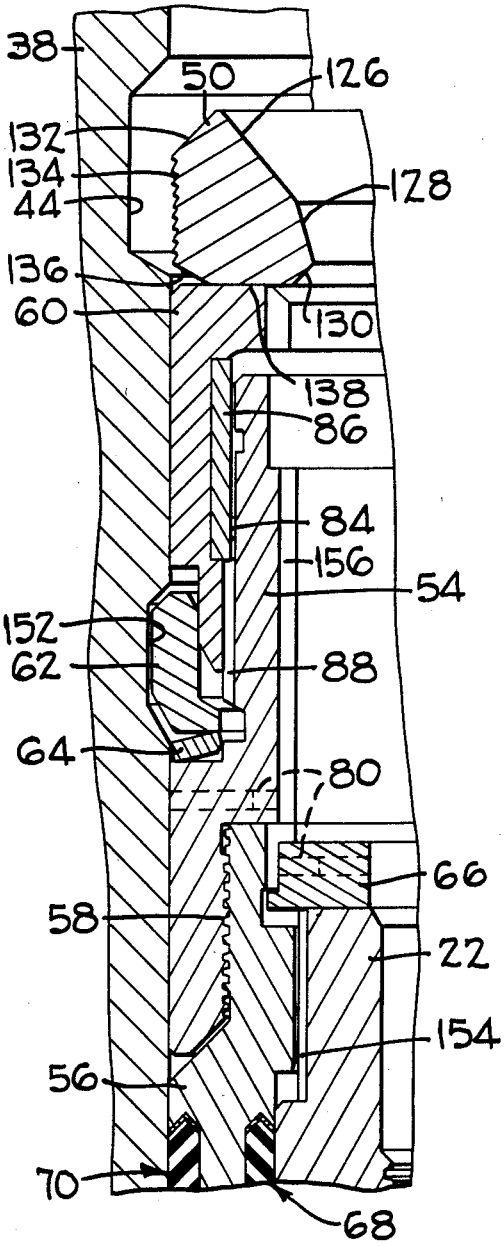

The packoff sealing areas of the wellhead housing and the hanger 24, i.e., those areas against which the packoff assembly packings 70, 68, respectively will interface, are cleaned by known methods. The packoff assembly 36 is releasably secured to a running tool (not shown) by a plurality of threaded shear pins 82 (FIG. 3) (one shown) and the assembly run (lowered) on drill pipe (not shown) until it lands on the upper shoulder 150 (FIG. 2) of the hanger 24, thereby placing the packoff assembly lock ring 62 in alignment with its mating annular groove 152 in the wellhead housing 38 (FIGS. 1 and 7). The lock ring 62 remains retracted within the wellhead housing bore until the expander mandrel 60 is forced downward by the running tool. The running tool is then rotated to the right, thereby shearing the pins 82 since the packoff assembly upper body 54 and lower body 56 are held against relative rotation by the anti-rotation ring 66, and the lower body is anti-rotationally keyed at 154 (FIGS. 1 and 2) to the adjacent casing hanger. The running tool then drops, forcing the expander mandrel downward and partially expanding the lock ring 62 into the groove 152, as shown in FIG. 8.

As the running tool rotates it aligns with vertical axial slots (only one shown) 156 in the packoff assembly upper body 54 and drops further, causing the pins 80 to shear and the anti-rotation ring 66 to move downward out of engagement with the upper body 54 (FIG. 8), thereby freeing the upper body to rotate, and fully expanding the lock ring 62 into the groove 152.

Figure 9:
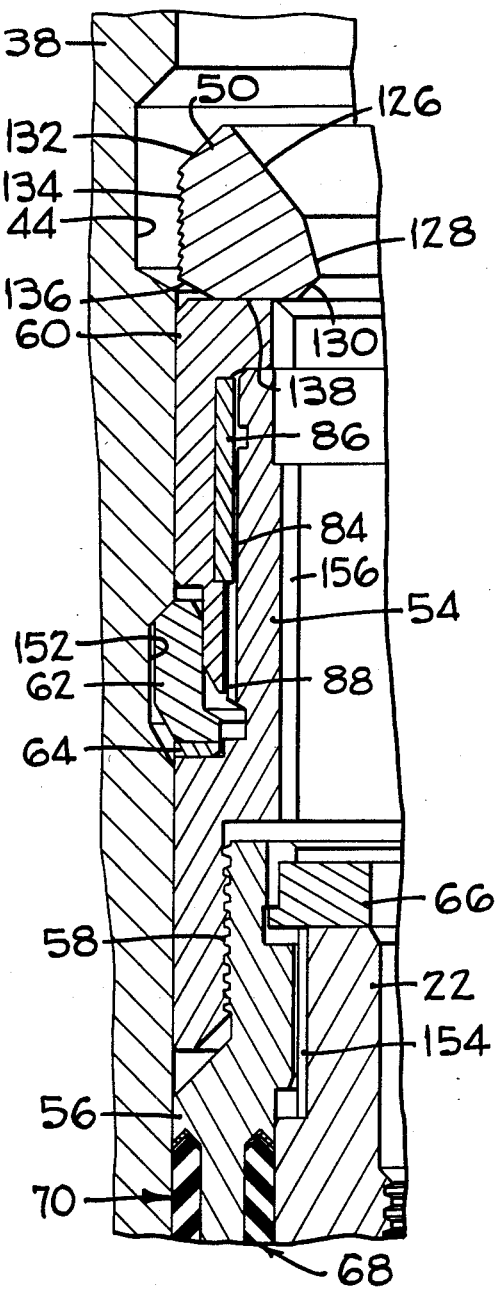

Further right-hand rotation of the running tool now also rotates the packoff assembly upper body 54, and as this rotation occurs the threads 58 cause the upper body and the lower body 56 to separate, resulting in a compressive force contained between the lock ring 62 and the casing hanger 24 that actuates the dual packings 68, 70 into a fluid tight seal of the annulus between the hanger and the wellhead housing, as shown in FIG. 9.

Testing the Packoff Assembly

Figure 10:
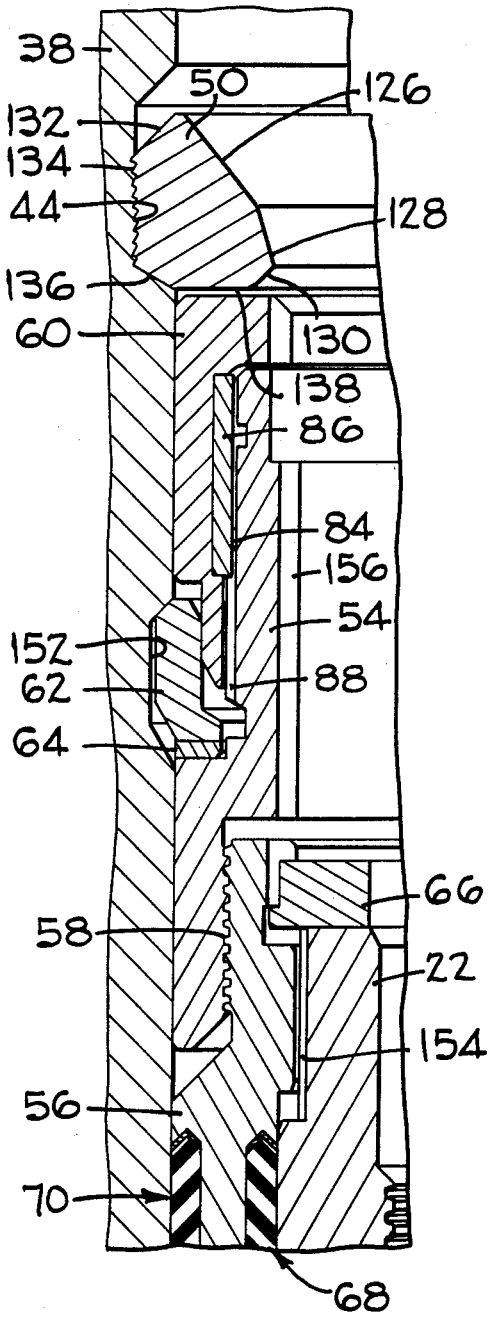
FIG. 10 is a view like FIGS. 7–9, showing the packoff assembly after installation and pressure testing.

The packings 68, 70 are then tested by closing the blowout preventers and pressuring up through the kill line. This pressure causes the running tool to drop further until it comes to rest on top of the load ring slips 50. As this downward movement, occurs the slips 50 are expanded outwardly and upwardly into their mating wellhead housing groove as shown in FIG. 10. This expansion of the slips 50 is accomplished by a ramp wedging action outward on the slips prior to imposition of the running tool weight on the slips, thereby assuring that the slips are properly in place in their wellhead housing groove before accepting any loading, and thus avoiding placement of loading on the packoff assembly.

If the pressure test is successful, the running tool is removed by release of the test pressure, opening the blowout preventers, applying drill string pressure to the running tool to release it from the packoff assembly, and lifting the tool from the wellhead housing.

If the pressure test is unsuccessful, the packoff assembly is retorqued for retesting, or released for removel. If removal is required, the packoff assembly is released by lifting the expander mandrel 60 with a separate retrieving tool, thereby releasing the lock ring 62 from its wellhead housing groove (FIG. 11). As lifting continues the load ring slips 50 are cammed inwardly from their wellhead housing groove into retracted position (FIG. 12). An annular sleeve (spring-loaded) is forced down over the load, and ring slips and the retracted slips 50 are locked in their retracted position by this sleeve on the retrieving tool for removal from the well without interference.

Installation of Subsequent Casing Hangers

Following completion of the next size drilling program, during which the load ring slips 50 of the packoff assembly 36 have been held in expanded position by a bowl protector, the next casing string 28 and its hanger 22 are lowered into the well until the hanger lands on the expanding slips. All subsequent operations are identical to those described above for each casing string-/hanger installation.

EMBODIMENT OF FIGS. 13–15

Figure 13:
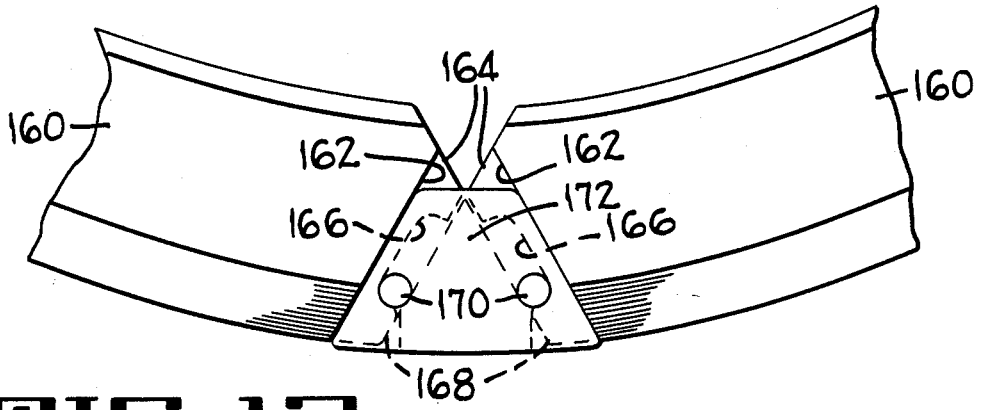
FIGS. 13–15 are views like FIGS. 4–6, showing another embodiment of load ring slips and their retainers.
Figure 14:
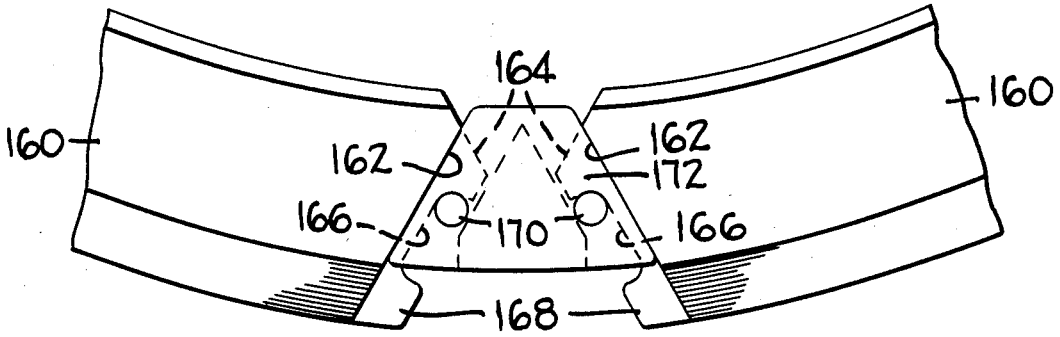
Figure 15:
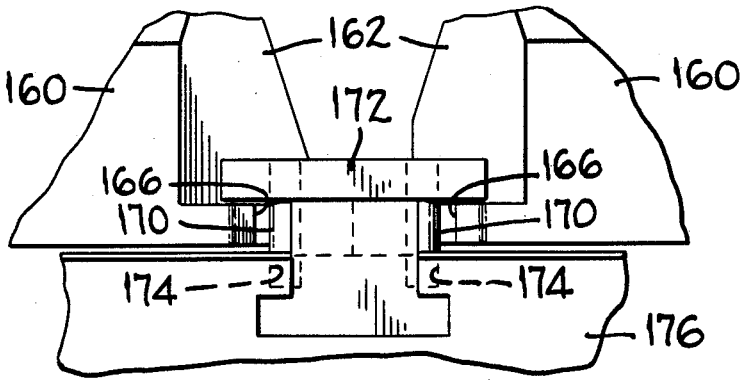

FIGS. 13–15 illustrate a modified version of the load ring slips and their retainers. In this embodiment the opposite ends of the slips 160 are identical, each end having an angular vertical surface 162, a horizontal surface 164 extending from the vertical surface 162, and a central relieved area 166 in the flange-like extension 168 that cooperates with a pair of vertical pins 170 to limit expansion and retraction of the slip to a selected distance. The pins 170 extend between the modified retainer 172 and holes 174 in the upper end of the packoff assembly expander mandrel 176. When viewed in plan the upper portion of the modified retainer 172 has a truncated pyramid shape (FIGS. 13 and 14) and a somewhat wider upper portion (FIG. 15) than that of the corresponding portion of the retainer 90. In functional aspects, however, the slips 160 and their retainers 172 are the same as their preferred embodiment counterparts.

Although the foregoing description of the apparatus of this invention and the procedure employed in its installation in a subsea well is for a specific casing string program, it should be understood that said apparatus and procedure is applicable to any casing string program required for drilling subsea wells where multiple concentric casing strings are configured on stacked hangers with restricted annulus clearances between casing strings.

Although the best mode contemplated for carrying out the present invention has been herein shown and described, it will be apparent that modification and variation may be made without departing from what is regarded to be the subject matter of the invention.

We claim:

1. A well casing suspension system for supporting a plurality of concentric casing strings at a wellhead, comprising:

(a) an annular wellhead housing having lower casing hanger support means;

(b) a lower casing hanger residing on the lower casing hanger support means;

(c) a packoff assembly in annulus-sealing position between the wellhead housing and the lower casing hanger;

(d) an upper casing hanger support means on the wellhead housing above the lower casing hanger and the packoff assembly; and (e) casing load support means attached to the packoff assembly for radial and axial movement with respect thereto between retracted and expanded positions, said casing load support means in expanded position cooperating with the wellhead housing to provide a support seat for an upper casing hanger and transfer the compressive load of said upper casing hanger directly to the wellhead housing.

2. A casing suspension system according to claim 1 wherein the lower casing hanger support means comprises an annular shoulder extending inwardly from the bore of the wellhead housing.

3. A casing suspension system according to claim 1 wherein the upper casing hanger support means comprises an annular groove in the bore of the wellhead housing.

4. A casing suspension system according to claim 1 wherein the lower casing hanger support means comprises an annular shoulder in the bore of the wellhead housing, and the upper casing hanger support means comprises an annular groove in the bore of the wellhead housing.

5. A casing suspension system according to claim 1 wherein the casing load support means comprises a plurality of arcuate load ring slips secured to an upper portion of the packoff assembly.

6. A casing suspension system according to claim 5 including means for limiting radial movement of the load ring slips between a retracted and an expanded position.

7. A casing suspension system according to claim 6 wherein the limiting means comprises a plurality of retainer elements positioned between opposed ends of the load ring slips and secured to an end portion of the packoff assembly.

8. A casing suspension system according to claim 7 wherein the retainer elements have a generally triangular slope in cross-section, and wherein two sides of the retainer elements cooperate with means on the ends of the load ring slips to retain said slips in functional attachment to the packoff assembly.

9. A casing suspension system according to claim 1 including means for elevating the casing load support means from rest position.

10. A well packoff assembly for packing off an annulus between a wellhead housing and a lower casing hanger, comprising an annular body and annular packing means on said body for establishing a pressure seal between said wellhead housing and said lower casing hanger, and radially expandable and retractable casing load support means retained on said body and cooperable with said wellhead housing to suspend an upper casing hanger directly from, and transfer the entire hang load of said upper casing hanger directly to, said wellhead housing.

11. A packoff assembly according to claim 10 wherein the casing load support means comprises a plurality of arcuate load ring slips attached to an upper portion of the annular body.

12. A packoff assembly according to claim 11 including means for limiting radial movement of the load ring slips between a retracted and an expanded position.

13. A packoff assembly according to claim 12 wherein the limiting means comprises a plurality of retainer elements positioned between opposed ends of the load ring slips and secured to an end portion of the annular body.

14. A method for suspending a plurality of concentric casing strings in a wellhead housing, comprising suspending an outer casing string on a lower support means in the wellhead housing, running, landing and setting a packoff assembly, which carries expandable and retractable hanger support elements, between the outer casing string and the wellhead housing, expanding the hanger support elements into cooperative engagement with the wellhead housing, and running and landing an inner casing string directly on the hanger support elements, thereby suspending the entire hang load of the inner casing string directly and totally from the wellhead housing.

15. A method according to claim 14 including the step of elevating the hanger support elements from their normal position on the packoff assembly to prevent imposition of any casing hang load on said assembly.

* * * * *